US010364640B2

(12) United States Patent
Rochen et al.

(10) Patent No.: US 10,364,640 B2
(45) Date of Patent: Jul. 30, 2019

(54) PACKER SETTING DURING HIGH FLOW RATE

(71) Applicant: Weatherford Technology Holdings, LLC, Houston, TX (US)

(72) Inventors: James A. Rochen, Waller, TX (US); Shawn J. Treadaway, Houston, TX (US); Tracy M. Martin, Houston, TX (US); Christopher A. Hall, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 186 days.

(21) Appl. No.: 15/276,094

(22) Filed: Sep. 26, 2016

(65) Prior Publication Data

US 2018/0087347 A1 Mar. 29, 2018

(51) Int. Cl.
*E21B 33/128* (2006.01)
*E21B 33/129* (2006.01)

(52) U.S. Cl.
CPC ..... *E21B 33/1285* (2013.01); *E21B 33/1293* (2013.01)

(58) Field of Classification Search
CPC .... E21B 33/12; E21B 33/122; E21B 33/1208; E21B 33/1216; E21B 33/128;
(Continued)

(56) References Cited

U.S. PATENT DOCUMENTS 4,433,847 A * 2/1984 Weinberg ..... E21B 33/1208 277/342
4,664,188 A 5/1987 Zunkel
(Continued)

FOREIGN PATENT DOCUMENTS

| | | | |
|---|---|---|---|
| CA | 2713684 | A1 | 2/2012 |
| WO | 02/08569 | A1 | 1/2002 |
| WO | 2009/146411 | A1 | 12/2009 |

OTHER PUBLICATIONS

Schlumberger, "Packers Catalog," copyright 2015, pp. 1, 31-38, 43-46, 122.

(Continued)

*Primary Examiner* — Brad Harcourt
*Assistant Examiner* — David Carroll
(74) *Attorney, Agent, or Firm* — Blank Rome LLP

(57) ABSTRACT

A packer is used for setting downhole in tubing subject to downhole flow at a high flow rate. The packer includes a setting element, a slip element, and a packing element. The setting element is disposed on the packer toward an uphole end and is activated hydraulically to move in a downhole direction toward a downhole end of the packer. The slip element is disposed toward the downhole end and is moveable outward toward the tubing in a first stage in response to the movement of the setting element. The packing element is disposed on the other elements and is at least partially carried by the setting element. The packing element is compressible outward toward the tubing in a second stage, after the first stage, in response to the movement of the setting element. Additionally, a choke ring or other element disposed on the packer at least downhole of the packing element can move outward toward the tubing in response to the setting movement to restrict the downhole flow in the annulus to a lower flow rate.

25 Claims, 6 Drawing Sheets

(58) Field of Classification Search
CPC ..... E21B 33/1285; E21B 33/1292; E21B 33/1293; E21B 33/1295; E21B 23/06
See application file for complete search history.

(56) References Cited

U.S. PATENT DOCUMENTS

| | | | | |
|---|---|---|---|---|
| 4,665,992 | A * | 5/1987 | Franc | E21B 33/1295 166/122 |
| 4,669,538 | A * | 6/1987 | Szarka | E21B 23/06 166/120 |
| 5,048,610 | A * | 9/1991 | Ross | E21B 33/122 166/117.5 |
| 2010/0326675 | A1 | 12/2010 | Doane | |
| 2016/0053569 | A1 | 2/2016 | Carro | |

OTHER PUBLICATIONS

Schlumberger, "MRP-ESP: Modular dual-completion packer," copyright 2014, 2-pgs.
Combined Search and Examination Report in counterpart GB Appl. GB1715268.7, dated Feb. 5, 2018, 8-pgs.

* cited by examiner

PACKER SETTING DURING HIGH FLOW RATE

BACKGROUND OF THE DISCLOSURE

Hydraulic set packers can be used for a number of implementations downhole. For example, a dual bore packer that is hydraulically set can be used for an electric submersible pump (ESP) system, such as shown in FIG. 1. In the ESP system, surface equipment 18 connects via production tubing 12, control line 14, and electric cable to a dual bore, hydraulically set packer 30. A packing element on the packer 30 seals in the casing 10, and slips on the packer 30 engage the casing wall.

Internally, the packer 30 communicates the production tubing 12 via one bore of the packer 30 to an electric submersible pump 20. The packer 30 also communicates a feed-through of the electrical cable 16 via another bore on the packer 30 to the motor of the pump 20. (Mating connectors and a sealed mandrel can be used for the feedthrough to maintain a pressure barrier.) The packer 30 is typically set hydraulically using hydraulics communicated via the control line 14. Ultimately, the packer 30 serves a number of purposes, such as preventing free gas from venting up the annulus, isolate the annulus above the pump 20, etc.

FIGS. 2A-2B illustrate two types of hydraulic set packers 30A-B of the prior art as may typically be used for an ESP system. The hydraulic set packers 30A-B can be set in two different directions, including up and down component movement as in FIG. 2A or all components can move in upward direction as in FIG. 2B. In particular, the packer 30A in FIG. 2A includes a hydraulic setting component 34 disposed between slips 38 (at the packer's downhole end 32*d*) and a packing element 36 (at the packer's uphole end 32*u*). Activation of the hydraulic setting component 34 uses down component movement to the set the slips 38 and uses up component movement to set the packing element 36.

In contrast to this arrangement, the packer 30B in FIG. 2B includes the hydraulic setting component 34 disposed toward the downhole end 32*d* of the packer 30B, followed by the slips 38 and the packing element 36 towards the uphole end 32*u*. Activation of the hydraulic setting component 34 uses up component movement to the set both the slips 38 and the packing element 36.

Issues can occur when setting these hydraulic set packers 30A-B. In one example, the packer 30A-B may be used in a well suffering high loss rates. In setting the packer 30A-B, fluid in the annulus of the casing around the packer 30A-B may flow rapidly further down the casing and into the lossy formation. In another example, a valve may be opened below the packer 30A-B prior to setting the packer 30A-B. The opening of the valve may cause a high flow rate (~12 bbl/min at ~150 deg-F) to pass across the outside of the packer 30A-B while the packer 30A-B is setting. Setting the packers 30A-B in such high flow rates in either of these situations can cause failure of the packer 30A-B.

What is needed is a packer that can be set in high flow rates without causing damage during setting. The subject matter of the present disclosure is directed to overcoming, or at least reducing the effects of, one or more of the problems set forth above.

SUMMARY OF THE DISCLOSURE

According to the present disclosure, a packer is used for setting downhole in tubing. The packer comprises a setting element, a slip element, and a packing element. The setting element is disposed on the packer toward an uphole end and is activated hydraulically to move in a downhole direction toward a downhole end of the packer. The slip element is disposed on the packer toward the downhole end and is moveable outward toward the tubing in a first stage in response to the movement of the setting element in the downhole direction. The packing element is disposed on the packer between the setting element and the slip element. The packing element is at least partially carried by the setting element. In a second stage, after the first stage, in response to the movement of the setting element in the downhole direction, the packing element is compressible outward toward the tubing.

The packer can comprises a mandrel having at least one bore defined therethrough and having the setting element, the slip element, and the packing element disposed thereon. The setting element can comprise a piston disposed in a chamber in communication with hydraulic pressure so that the piston can be movable in the downhole direction in response to the hydraulic pressure in the chamber. The chamber can communicate with the hydraulic pressure from a control line, and the piston can comprise T-seals engaging the chamber. Finally, the packer can comprise at least one lock disposed on the packer to preventing movement of at least one of the setting element, the slip element, and the packing element in an uphole direction.

In one arrangement, the setting element comprises a sleeve carrying the packing element disposed thereon. The sleeve is movable in the downhole direction and transfers the movement to the slip element. Meanwhile, a first temporary connection of the sleeve to a portion of the packing element can prevent compression of the packing element up to a first threshold. This portion of the packing element can transfer the movement to a portion of the slip element. Moreover, the setting element can comprise a second temporary connection to the packer. This second temporary connection prevents the movement of the setting element up to a second threshold lower than the first threshold.

According to one configuration, the packer can comprise a choke element disposed on the setting element. The choke element is movable outward toward the tubing in the first stage so that the choke element moved outward can restrict passage of flow in the downhole direction between the packer and the tubing. The choke element preferably comprises a dissolvable material.

In one arrangement, the setting element comprises a plurality of slips disposed circumferentially about the packer. The choke element can comprise a ring disposed circumferentially about the slips and at least partially covering spaces between the slips. Alternatively, the choke element can comprise a plurality of segments disposed in spaces between the slips.

According to another configuration, the packer can comprise a choke element disposed on the packer toward the downhole end. The choke element is movable outward toward the tubing in an initial stage, before the first stage, in response to the movement of the setting element in the downhole direction. In this way, the choke element moved outward restricting passage of flow in the downhole direction between the packer and the tubing. In one arrangement, for example, the slip element is at least partially carried by a portion of the packing element. This transfers the movement in the downhole direction to the choke element up to an initial threshold in the initial stage, after which the movement moves the setting element outward towards the tubing in the first stage.

In one arrangement, the slip element comprises upper and lower cones and one or more slips. The upper and lower cones are disposed on the packer and are at least moveable toward to one another. The one or more slips are disposed between the upper and lower cones and are moveable outward from the packer toward the tubing in response to movement of the upper and lower cones toward one another. The upper cone can be part of or fixed to a portion of the packing element, and the portion of the packing element can be affixed to a portion of the setting element with a temporary connection. For its part, the lower cone can be fixed to the packer.

In one arrangement, the packing element comprises upper and lower rings and a compressible sleeve. The upper and lower rings are disposed on a portion of the setting element and are at least moveable toward to one another. The compressible sleeve is disposed on the portion of the setting element and is compressible between the upper and lower rings in response to movement of the upper and lower rings toward one another. The upper ring can be part of or fixed to the portion of the setting element. For its part, the lower ring can comprise a temporary connection affixing the lower ring to the portion of the setting element to prevent movement of the lower ring thereon up to a threshold.

According to the present disclosure, a method of setting a packer downhole in tubing comprises: hydraulically activating a setting element disposed on the packer toward an uphole end to move in a downhole direction toward a downhole end of the packer; moving a slip element disposed on the packer toward the downhole end outward toward the tubing in a first stage in response to the movement of the setting element in the downhole direction; at least partially carrying a packing element, disposed on the packer uphole of the slip element, on portion of the setting element; and compressing the packing element outward toward the tubing in a second stage, after the first stage, in response to the movement of the setting element in the downhole direction.

According to the present disclosure, a packer is used for setting downhole in tubing subject to downhole flow at a first flow rate. The packer comprises a setting element, a packing element, a slip element, and a choke element. The setting element is disposed on the packer and is activated to move on the packer. The packing element is disposed on the packer and is compressible outward toward the tubing in response to the movement of the setting element. Finally, the slip element is disposed on the packer and is moveable outward toward the tubing in response to the movement of the setting element.

For its part, the choke element is disposed on the packer at least downhole of the packing element. The choke element is movable outward toward the tubing in response to the movement of the setting element. In this way, the choke element restricts the downhole flow in the annulus between the packer and the tubing to a second flow rate less than the first flow rate. The choke element preferably moves outward at least prior to the compression of the packing element.

According to the present disclosure, a method of setting a packer downhole in tubing subject to downhole flow at a first flow rate comprises: activating a setting element to move on the packer; compressing a packing element disposed on the packer outward toward the tubing in response to the movement of the setting element; moving a slip element disposed on the packer outward toward the tubing in response to the movement of the setting element; and restricting the downhole flow in the annulus between the packer and the tubing to a second flow rate less than the first flow rate by moving a choke element disposed on the packer at least downhole of the packing element outward toward the tubing in response to the movement of the setting element.

The foregoing summary is not intended to summarize each potential embodiment or every aspect of the present disclosure.

DETAILED DESCRIPTION OF THE DISCLOSURE

Figure 1:
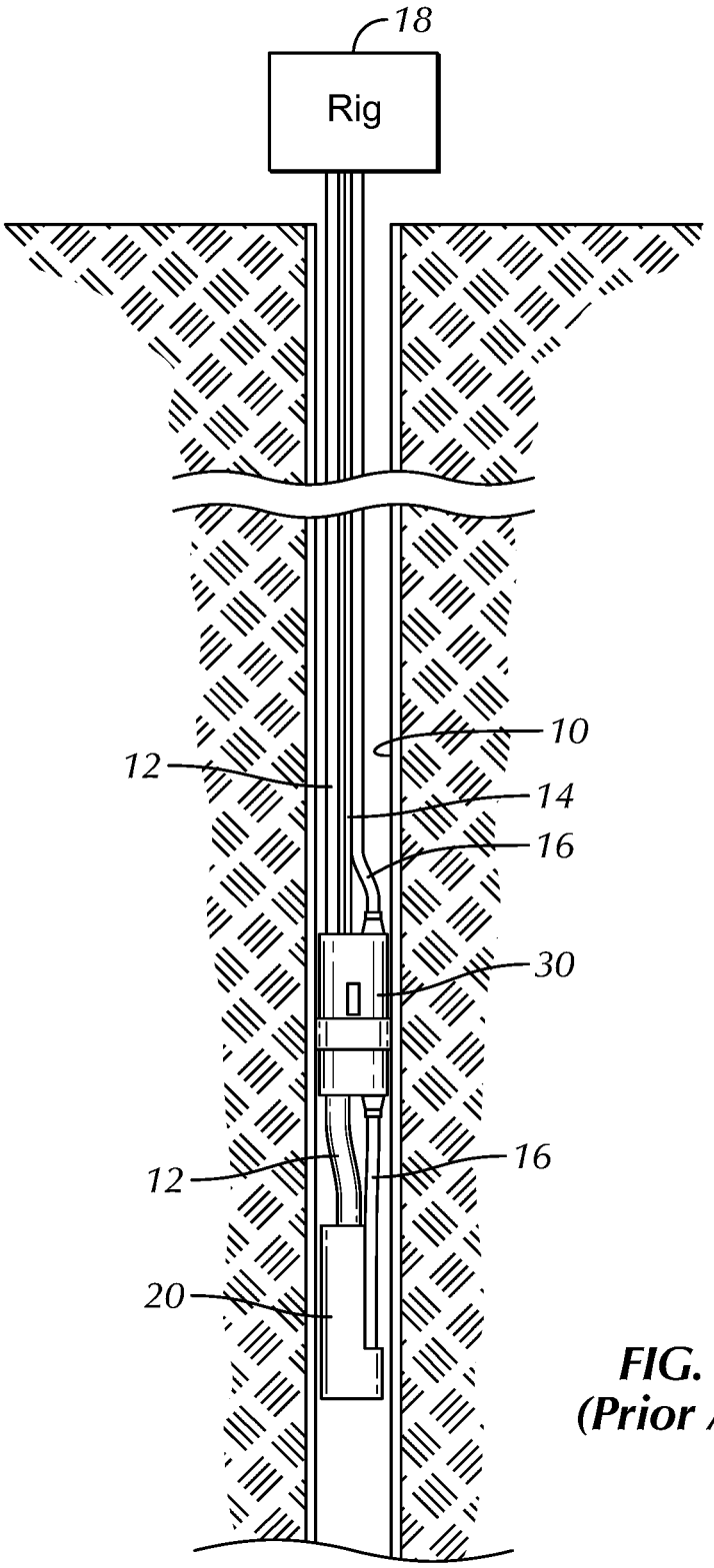
FIG. 1 (Prior Art)
FIG. 1 illustrates an electric submersible pump (ESP) system having a packer according to the prior art.
Figure 2A:
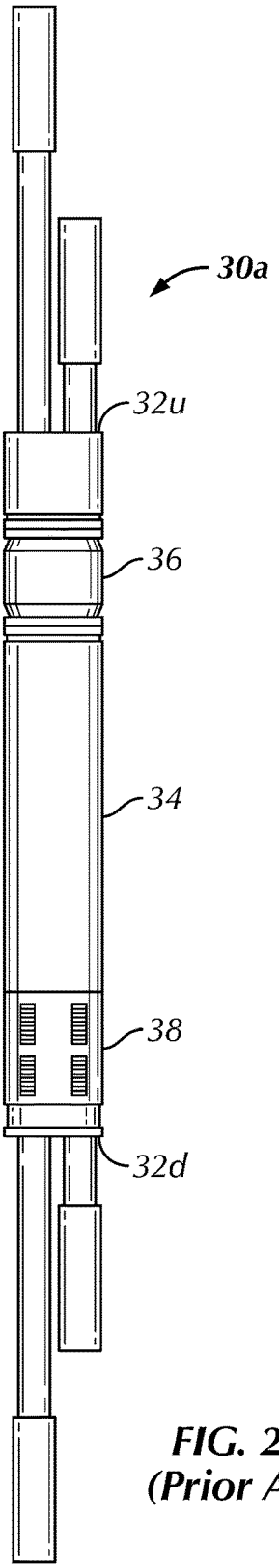
FIG. 2A (Prior Art)
FIGS. 2A-2B illustrate prior art hydraulic set packers, such as used for an ESP system.
Figure 2B:
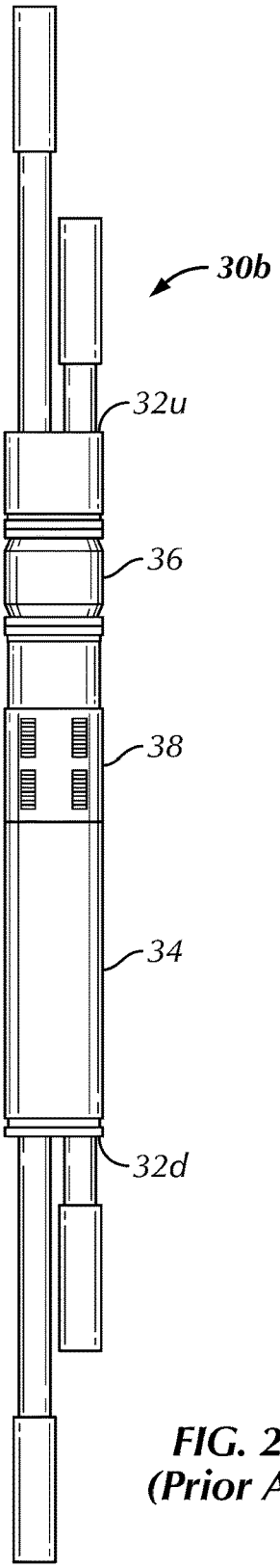
FIG. 2B (Prior Art)
Figure 3:
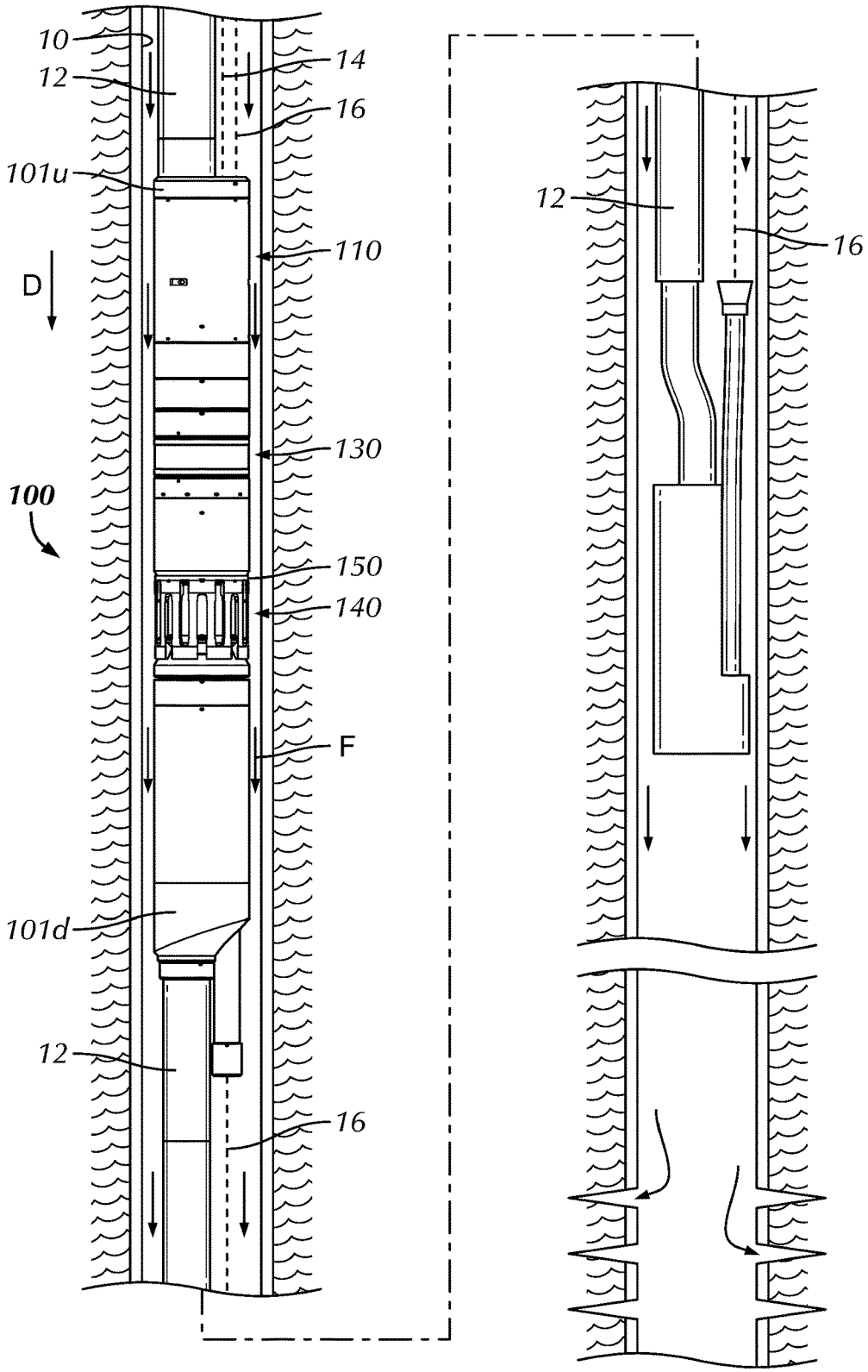
FIG. 3 illustrates a hydraulic set packer according to the present disclosure, which can be used in an electric submersible pump (ESP) system.

FIG. 3 illustrates a hydraulic set packer 100 according to the present disclosure. Here, the packer 100 is shown for use in an electric submersible pump (ESP) system, but other implementations are possible. In general, the packer 100 connects at its uphole end 101*u* to production tubing 12 from the surface and communicates with a tubing section 12 at its downhole end 101*d* to an electric submersible pump 20. A control line 14 and an electrical cable 16 run downhole along the tubing 12 and couple to the packer's uphole end 101*u*, and a section of the cable 16 passing through the packer 100 extends from the packer's downhole end 101*d* to the electric submersible pump 20.

The packer 100 includes a hydraulic setting element 110 disposed toward the packer's uphole end 101*u*, followed by a packing element 130 and a slip element 140 towards the downhole end 101*d*. The setting element 110 is activated hydraulically to move in a downhole direction D toward the packer's downhole end 101*d*. The slip element 140 is moveable outward toward and against tubing (e.g., casing 10) in a first stage in response to the movement of the setting element 110 in the downhole direction D.

The packing element 130 disposed between the setting and slip elements 110, 140 is at least partially carried by the setting element 110. Eventually, in a second stage after the first stage of setting the slip element 140, the packing element 130 is compressed to expand outward toward and against the casing 10 in response to the movement of the setting element 110 in the downhole direction D.

As will be appreciated, reference to movement of the setting element 110 and other components refers equally to an application of force, compression, load or the like without necessarily involving actual physical displacement of the component. Accordingly, reference to "movement" as used here can be equally expressed as "force," "load," etc.

As noted in the background of the present disclosure, issues can occur when setting a hydraulic set packer when subject to high flow rates. The present packer 100, however, overcomes these issues. In the current example, the packer 100 may be used in a well suffering high loss rates, such that fluid F in the annulus of the casing 10 around the packer 100 tends to flow rapidly to further downhole and into the lossy formation. In another example implementation, a valve (not shown) may be opened below the packer 100 prior to setting the packer 100. The opening of such a valve may cause a high rate (~12 bbl/min at ~150 deg-F) of the flow F to pass across the outside of the packer 100 while the packer 100 is setting. Setting the packer 100 of the present disclosure in such high flow rates in either of these situations as well as others can avoid damage and failure of the packer 100.

In particular, the disclosed packer 100 allows for all of the moving components (e.g., the setting element 110, the packing element 130, and the slip element 140) to move downward during setting in the downhole direction D of the high flow rate. In this way, the components of the disclosed packer 100 can move downward during setting while an approximately 12 bbl/min flow rate at +/−150 Deg-F may be flowing along the annulus. Having all of the components moving downward in this manner can thereby reduce the risk of damage to the packing element 130 during its setting and can ensure proper setting of the packer 100 by not having the components move against the direction of flow.

Additionally, the disclosed packer 100 has a staged setting sequence. In particular, the setting element 110 actuates the slip element 140 first, which anchors the packer 100 in place. The packing element 130 then actuates last. Setting the slip element 140 situated downhole from the packing element 130 and set prior to deployment of the packing element 130 can reduce the rate of flow F across packer 100 by virtue of a choking effect from the element 140, which can mitigate damage to the packing element 130 when it sets.

Furthermore, the disclosed packer 100 is fitted with an annulus flow choke element 150 that deploys before or concurrently with the setting of the slip element 140 (but prior to pack-off of the packing element 130). Here, the flow choke element 150 is a ring, and the deployed flow choke ring 150 can help restrict and slow the flow rate across packer's outer surface prior to the later setting of the packing element 130. This flow restriction can reduce the chances of damage to the element 130 and can ensure proper element packer-off. Accordingly, deploying the annulus flow chock ring 150 prior to deployment of the packing element 130 can further reduce the rate of flow across packer 100 by virtue of a choking effect and can mitigate damage to the packing element 130.

Figure 4A:
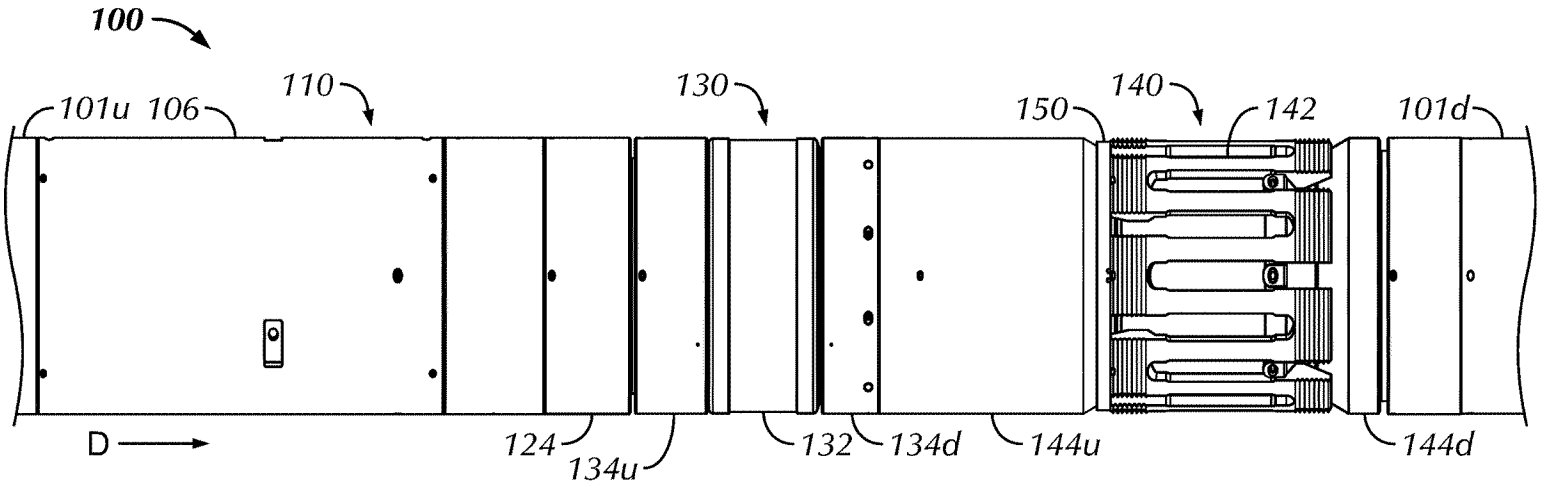
FIG. 4A illustrates an elevational view of portion of a hydraulic set packer according to the present disclosure.

Turning now to further details of the disclosed packer 100, FIG. 4A illustrates an elevational view of portion of the hydraulic set packer 100 according to the present disclosure. As noted, the packer 100 can be a dual bore packer having separate bores for use in an electric submersible pump system (as shown in FIG. 3). Alternatively, the packer 100 can be a dual bore packer having separate bores for use in a dual production system or other implementation. Moreover, the packer 100 can be a mono-bore packer for coupling at its ends to singular production tubing. For this reasons, particular features of the one or more bores, control line passages, and the like inside the packer 100 are not shown here, nor are the couplings on the ends of the packer 100 shown. Such features will be appreciated by one skilled in the art and are not discussed.

Figure 4B:
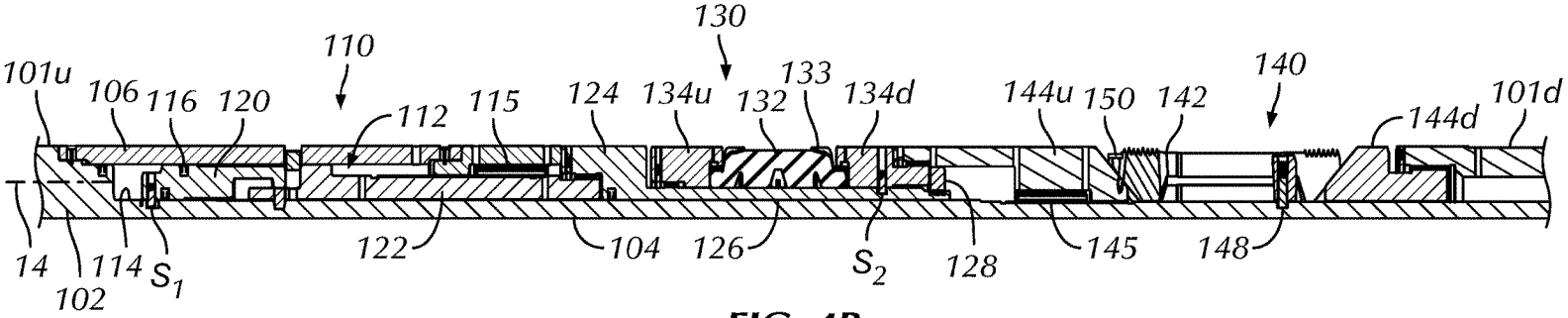
FIG. 4B illustrates a cross-section of the portion of the packer in an inactive condition.

As noted above, the packer 100 includes the hydraulic setting element 110 disposed toward the packer's uphole end 101*u*, followed by the packing element 130 and the slip element 140 towards the downhole end 101*d*. In FIG. 4A, these elements 110, 130, and 140 are shown in an inactive condition. Details of these elements in the inactive condition are also shown in the cross-section of FIG. 4B.

The packer 100 includes a mandrel or tool body 102 having at least one bore 104 defined therethrough and having the setting element 110, the slip element 140, and the packing element 130 disposed thereon. The setting element 110 includes a piston 112 movable in a hydraulic chamber 114, which is defined between the packer's mandrel 102 and an external housing 106. The outer housing 106 may be comprised of several components to facilitate assembly.

The chamber 114 as schematically shown preferably communicates with hydraulic fluid from a control line 14. However, ports (not shown) in the bore 104 of the packer's mandrel 102 may instead be used to provide tubing pressure to the chamber 114. Other arrangements can be used. In this way, the setting element 110 can be activated by hydraulic fluid from a control line, tubing pressure, or elsewhere.

The piston 112 is sealed in the chamber 114 by various seals 116. Preferably, the seals 116 are T-seals rather than O-ring seals. Use of the control line and the T-seals 116 offer the advantage of reducing leak paths of the packer 100.

The piston 112 sealed in the chamber 114 is in communication with hydraulic pressure so that the piston 112 is movable in the downhole direction D in response to the hydraulic pressure in the chamber 114. The piston 112 may also be comprised of several components, such as 120, 122, 124, 126, and 128, interconnected and movable together. At least a portion of the piston 112 is a sleeve 126 disposed on the packer 100 and is movable in the downhole direction D. The sleeve 126 carries the packing element 130 disposed thereon, and the sleeve 126 is engageable with a portion (e.g., uphole cone 144*u*) of the slip element 140.

If desired, a releasable lockout can be provided between one part 120 of the piston 112 and another part 122. Additionally, the piston 112 may use a body lock ring 115 with the housing 106 (or the packer mandrel 102) to prevent reverse movement of the piston 112 once shifted downhole by hydraulic pressure in the chamber 114.

The setting element 110 includes a first temporary connection S1 to the packer 100 that restrains the movement of the setting element 110 to a first threshold. In particular, the piston 112 is affixed to the packer's mandrel 102 by a first temporary connection or shear pin S1 shown here at the piston head 120. The setting element 110 further include a second temporary connection or shear pin S2 to the packing element 130 that restrains compression of the packing element 130 to a second threshold higher than the first threshold. In particular, the sleeve 126 has the second temporary connection S2 to portion (e.g., lower end ring 134*d*) of the packing element 130 and restrains compression of the packing element 130 to the second threshold higher than the first threshold.

The packing element 130 includes a compressible sleeve 132 having backup rings 133 and end rings 134*u-d* at both ends. As noted above, the packing element 130 is disposed on portion (e.g., sleeve 126) of the setting element 110. In particular, the element's sleeve 132 and rings 133/134*u-d* are situated on the intermediate sleeve 126 of a push element 124 of the piston 112. The upper end ring 134*u* of the element 130 affixes to the sleeve 126 (or shoulders against the piston's push element 124), while the lower end ring 134*d* is affixed to the sleeve 126 by the second temporary connection or shear pin S2, which restrains movement on the lower ring 140*d* thereon to the second threshold. With release of the second connection S2 as discussed later, the rings 134*u-d* are at least moveable toward to one another during setting, and the compressible sleeve 132 is compressible between the upper and lower rings 134*u-d* in response to movement of the rings 134*u-d* toward one another.

The slip element 140 includes upper and lower cones 144*u-d* disposed on the packer 100 that are at least moveable toward to one another. The element 140 also includes one or more slips 142 disposed between the upper and lower cones 140*u-d*. The slips 142 are moveable outward from the packer 100 toward the casing in response to movement of the upper and lower cones 144*u-d* toward one another.

The upper cone 144*u* is coupled to portion of the packing element 130, which in turn is affixed to portion of the setting element 110 with the second temporary connection S2 mentioned above. Meanwhile, the lower cone 144*d* is fixed to the packer. In particular, the upper cone 144*u* is connected to the lower end ring 134*d* of the packing element 130 and is spaced from a distal end 128 of the setting sleeve 126. The upper cone 144*u* can have a lock, such as a body lock ring 145, disposed with the packer's mandrel 102, which can prevent reverse movement of the upper cone 144*u* once moved downhole. For its part, the lower cone 144*d* is connected to the outer housing 106 of the packer 100 and is thereby held relatively fixed in place on the packer's mandrel 102.

The slip element 140 in this example includes an interconnected arrangement of the slips 142 expandably disposed between the opposing cones 144*u-d*. Other slip arrangements can be used, such as independently movable slips or the like. The interconnected slip arrangement shown here is advantageous in that the spring like nature of the arrangement tends to hold the slips 142 against the packer's mandrel 102 until activated. All the same, the slips 142 can be affixed in place with a temporary connection or shear pins (not shown) if necessary. Catches 148 can be disposed on the packer mandrel 102. Although not shown, these catches 148 may be used to engage on the slip element 140 when retrieving the packer 100.

Figure 4C:
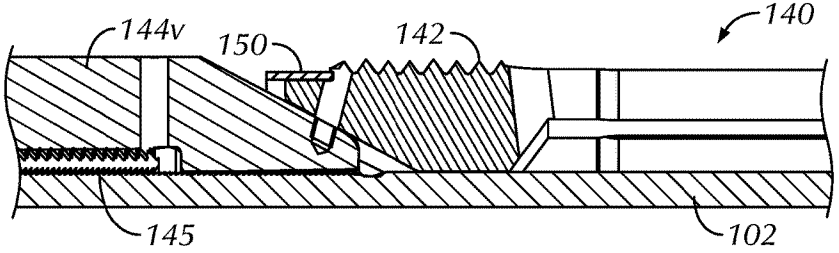
FIG. 4C illustrates isolated detail of part of the slip on the disclosed packer.

Finally, the slip element 140 includes the flow choke element 150 in the form of a ring disposed about the slips 142. Details of the flow choke ring 150 can be seen in FIG. 4C, which shows part of a slip 142 on the disclosed packer. The flow choke ring 150 is disposed circumferentially about the packer, extends around each of the slips 142, and is disposed at the uphole end in this arrangement. The ring 150 assists in the setting of the disclosed packer 100 by reducing the flow rate along the outside of the packer 100 during setting, especially when compressing the packer element 130. In general, the ring 150 can be composed of annealed steel or the like, but preferably the ring 150 is composed of ductile, dissolvable metal, such as a magnesium alloy or the like.

The thickness of the ring 150 can be configured for an implementation and can be thicker than depicted here. In one implementation in which the packer 100 is subject to a flow rate of up to 13 bbl/min in the annulus outside the packer 100, the choke ring 150 may be capable of reducing the flow rate to about 8 bbl/min. The dissolvable ring 150 if thicker than depicted can even operate as an initial pack-off for the setting of the packer 100. Being dissolvable, the ring 150 will eventually dissolve in the downhole fluids so that no components remain that could hinder retrieval of the packer 100.

Having an understanding of the components of the disclosed packer 100, discussion now turns to its activation for setting in casing, especially when there is a high flow rate in the downhole direction along the outside of the packer 100 from the uphole end 101*u* toward the downhole end 101*d*, as described previously with reference to FIG. 3.

Figure 5:
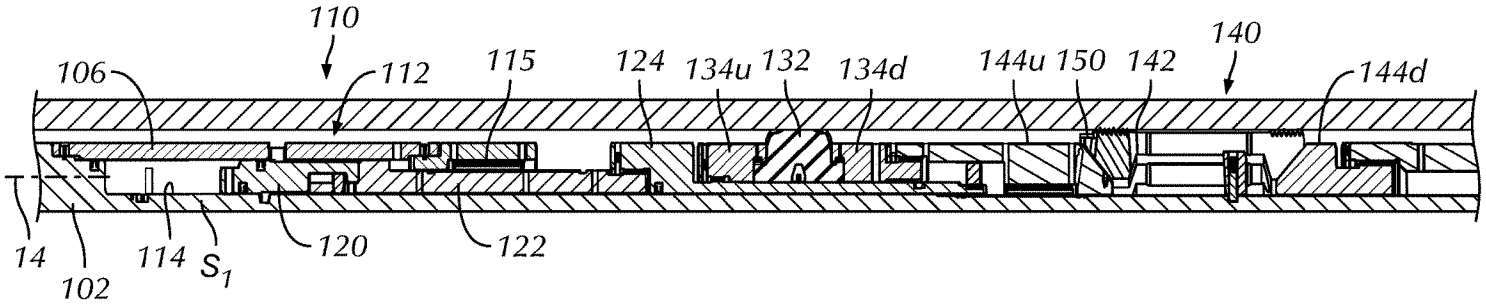
FIG. 5 illustrates a cross-section of the portion of the packer in an active condition set in casing.

For discussion, FIG. 5 illustrates a cross-section of the portion of the packer 100 in an active condition set in casing 10, which can be contrasted with the packer 100 shown in the inactive condition in FIG. 4A. The packer 100 is deployed downhole in the tubing or casing 10 to the desired depth. Setting begins with hydraulically activating the setting element 110 disposed on the packer 100 toward the uphole end 101*u*. As noted, control line pressure or tubing pressure building in the chamber 114 can push against the element's piston 112. To avoid premature activation of the packer, the pressure must preferably build up to an initial threshold until the first, initial temporary connection or shear pin S1 is broken. The piston 122 moves in a downhole direction toward the packer's downhole end 101*d*. (A lock out/catch arrangement may be present between the piston head 120 and the sliding sleeve 122 of the piston 112.)

In response to the movement of the setting element 110 in the downhole direction D, the slip element 140 disposed on the packer 100 toward the downhole end 101*d* moves outward against the casing 10 in a first setting stage. Activation of the packing element 130 is skipped because the element 130 is carried by the sleeve 126. Instead, the sleeve 126 is coupled by the second temporary connection S2 to the lower end ring 134*d*, and the lower end ring 134*d* is coupled to the upper cone 144*u*. The movement of the sleeve 126 thereby pushes the upper cone 144*u* downward toward the lower cone 144*d*. The slips 142 shear free if pined to the cone 144*u*, and the ends of the slips 142 ride up on the inclines of the cones 144*u-d*. As the slips 142 move outward from the packer's mandrel 102, the slips 142 engage against the inside wall of the casing 10 to anchor the packer 100 in place.

As the slips 142 move outward, they tend to choke the flow in the annulus. Moreover, the choke ring 150 also moves outward to further restrict any downhole flow in the annulus. In particular, the slips 142 provide some restriction to the flow, but may allow flow through the separations or gaps between the slips 142. The choke ring 150 circumferentially arranged around the ends of the slips 142, however, tends to close off or further restrict flow through the separations or gaps between the slips 142. In the end, the downhole flow in the annulus between the packer 100 and the casing 10 can be restricted to a second flow rate less than the first flow rate as both the slips 142 and the choke ring 150 move into the annulus.

All the while, the packing element 130 disposed on the packer 100 between the uphole and downhole ends 110*u-d* is at least partially carried on the sleeve 126 of the setting element 110. In response to the further movement/force of the setting element 110 in the downhole direction D, the packing element 130 is then compressed outward against the casing in a second setting stage, after the first stage. In particular, pushing of the piston's sleeve 126 against the upper cone 144*u* eventually reaches a limit and breaks the second temporary connection or shear pin S2 so that the sleeve 126 can shift free of the lower end ring 134*d*. The push member 124 of the piston 112 pushes the upper end ring 134*u* toward the lower end ring 134*d* and compresses the compressible sleeve 132. Setting of the slips 142 can still proceed through the compression of the packing element 130. The body lock rings 115 and 145 on the packer 100 can then limit reverse movement of the pushed components to keep the packer 100 set in the casing 10.

Figure 6:
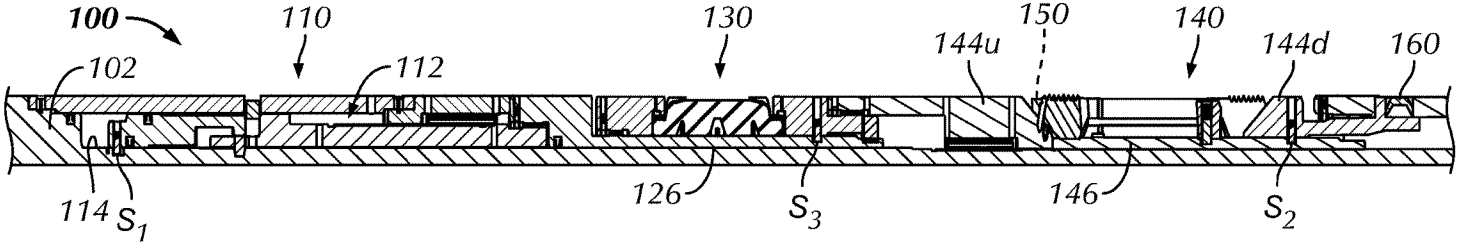
FIG. 6 illustrates a cross-section of portion of another packer in an inactive condition.

In the above arrangement, the flow choke ring 150 is used on the slip element 140. Other arrangements are possible in which a flow choke element, such as a ring or other body, can reduce flow in the annulus prior to setting of the packing element 130. For example, FIG. 6 illustrates a cross-section of portion of another packer 100 in an inactive condition. The packer 100 includes a separate choke element 160 in the form of a ring disposed toward the packer's downhole end 101*d*. This choke ring 160 can be used instead of or in addition to the choke ring 150 on the slips 142. This separate choke ring 160 is compressible outward toward the casing (10) in an initial stage, before the first stage in the setting of the slip element 140, in response to the movement of the setting element 110 in the downhole direction D. In particular, the slip element 140 is at least partially carried with the movement of the setting element 110 in a manner similar to that used for the packing element 130.

To achieve this, the upper cone 144*a* includes a sleeve extension 146 on which the lower cone 144*d* is disposed. A temporary connection or shear pin S2 affixes the lower cone 144*d* to the sleeve extension 146. Therefore, the initial pushing of the setting element's sleeve 126 coupled by the temporary connection S3 to lower end ring 134*d* passes to upper cone 144*u* connected to the sleeve 126. This initial pushing passes to the lower cone 144*d* without setting the slip element 140 and without setting the packing element 130. Instead, the lower cone 144*d* compress against the choke ring 160, which extends outward into the annulus to reduce the flow rate.

With continued movement/force of the setting element 110, this intermediate connection S2 eventually shears, allowing the cones 144*u-d* to move toward one another to set the slips 142. The same setting stages can then follow as in the previous embodiment to set the packer 100 with the final temporary connection S3 shearing to allow for compression of the packing element 130.

Figure 7A:
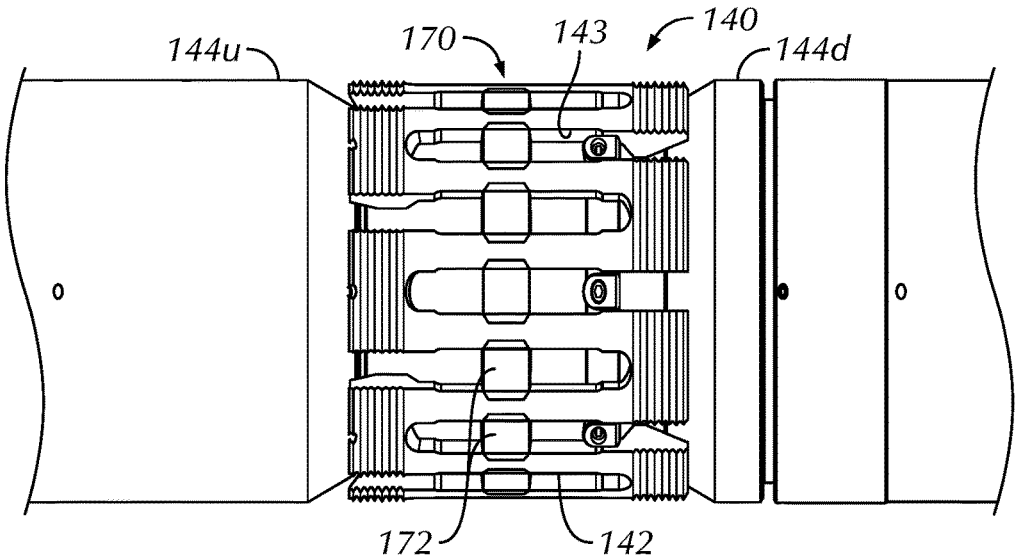
FIGS. 7A-7B illustrate elevational and cross-sectional views of portion of the disclosed packer having another flow choke element according to the present disclosure.
Figure 7B:
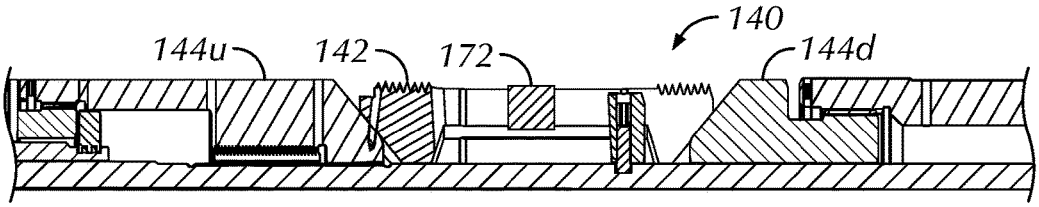
Figure 7C:
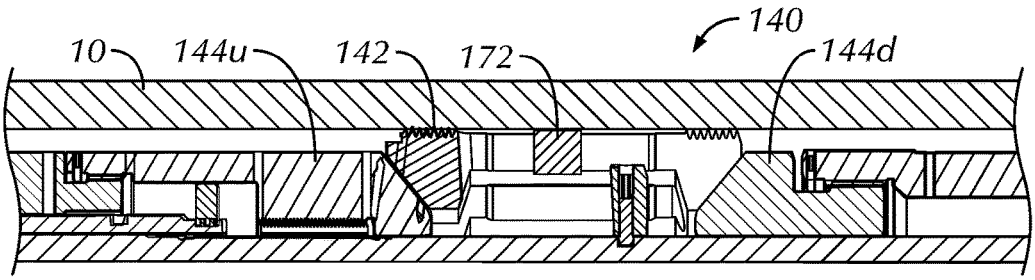
FIG. 7C illustrates a cross-sectional view of the packer portion from FIG. 7B in an active condition.

Rather than a separate ring as in the above arrangements, a flow choke element 170 as shown in FIGS. 7A-7C can include a plurality of individual spacer 172 or dogs of dissolvable material installed in the slots 143 of the slips 142. The spacers 172 can clip into place between the slips 142 and can be held in place to the slips 142 using fasteners (not shown), lips, shoulders, or other affixing means. The spacers 172 remain in place as the slips 142 expand outward when the cones 144*u-d* come together in an active condition, as exemplified in FIG. 7C. In this way, the spacers 172 can fill the voids in the spaces 143 between the slips 142 at least temporarily when the slips 142 are moved toward the surrounding casing 10 so the spacers 172 can reduce/choke the flow along the outside of the packer during and after setting.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A packer for setting downhole in tubing subject to downhole flow at a first flow rate in an annulus between the packer and the tubing, the packer comprising:

a setting element disposed on the packer toward an uphole end and being activated hydraulically to move in a downhole direction toward a downhole end of the packer;

a slip element disposed on the packer toward the downhole end and being moveable outward toward the tubing in a first stage in response to the movement of the setting element in the downhole direction;

a packing element disposed on the packer between the setting element and the slip element and being at least partially carried by the setting element, the packing element being compressible outward toward the tubing in a second stage, after the first stage, in response to the movement of the setting element in the downhole direction; and a choke element disposed on the packer at least downhole of the packing element, the choke element being movable outward toward the tubing in response to the movement of the setting element, the choke element being configured to restrict the downhole flow in the annulus between the packer and the tubing to a second flow rate less than the first flow rate.

2. The packer of claim 1, comprising a mandrel having at least one bore defined therethrough and having the setting element, the slip element, and the packing element disposed thereon.

3. The packer of claim 1, wherein the setting element comprises a piston disposed in a chamber in communication with hydraulic pressure, the piston movable in the downhole direction in response to the hydraulic pressure in the chamber.

4. The packer of claim 3, wherein the chamber communicates with the hydraulic pressure from a control line, and wherein the piston comprises T-seals engaging the chamber.

5. The packer of claim 1, wherein the setting element comprises a sleeve carrying the packing element disposed thereon, the sleeve movable in the downhole direction and transferring the movement to the slip element.

6. The packer of claim 5, wherein the sleeve comprises a first temporary connection affixing the sleeve to a first portion of the packing element, the first temporary connection preventing compression of the packing element up to a first threshold of force against the first temporary connection.

7. The packer of claim 6, wherein the setting element comprises a second temporary connection affixing the setting element to the packer, the second temporary connection preventing the movement of the setting element up to a second threshold of force against the second temporary connection lower than the first threshold.

8. The packer of claim 6, wherein the first portion of the packing element is configured to transfer the movement to a second portion of the slip element.

9. The packer of claim 1, wherein the choke element is disposed on the slip element and is movable outward toward the tubing in the first stage, the choke element moved outward restricting passage of the downhole flow in the downhole direction between the packer and the tubing.

10. The packer of claim 9, wherein the choke element comprises a dissolvable material.

11. The packer of claim 9, wherein the slip element comprises a plurality of slips disposed circumferentially about the packer; and wherein the choke element comprises a ring disposed circumferentially about the slips and at least partially covering spaces between the slips.

12. The packer of claim 9, wherein the slip element comprises a plurality of slips disposed circumferentially about the packer; and wherein the choke element comprises a plurality of segments disposed in spaces between the slips.

13. The packer of claim 1, wherein the choke element is disposed on the packer toward the downhole end and is movable outward toward the tubing in an initial stage, before the first stage, in response to the movement of the setting element in the downhole direction, the choke element moved outward restricting passage of the downhole flow in the downhole direction between the packer and the tubing.

14. The packer of claim 13, wherein the slip element is at least partially carried by a portion of the packing element, the portion of the packing element transferring the movement in the downhole direction to the choke element up to an initial threshold of force in the initial stage, after which the movement moves the slip element outward towards the tubing in the first stage.

15. The packer of claim 1, wherein the slip element comprises:

upper and lower cones disposed on the packer and being at least moveable toward one another; and one or more slips disposed between the upper and lower cones and being moveable outward from the packer toward the tubing in response to movement of the upper and lower cones toward one another.

16. The packer of claim 15, wherein the upper cone is part of or is fixed to a first portion of the packing element, and wherein a temporary connection affixes a second portion of the slip element to the first portion of the packing element.

17. The packer of claim 15, wherein the lower cone is fixed to the packer.

18. The packer of claim 1, wherein the packing element comprises:

upper and lower rings disposed on a portion of the setting element and being at least moveable toward one another; and a compressible sleeve disposed on the portion of the setting element and being compressible between the upper and lower rings in response to movement of the upper and lower rings toward one another.

19. The packer of claim 18, wherein the upper ring is part of or fixed to the portion of the setting element.

20. The packer of claim 18, wherein the lower ring comprises a temporary connection affixing the lower ring to the portion of the setting element and preventing movement of the lower ring thereon up to a threshold of force against the temporary connection.

21. The packer of claim 1, further comprising at least one lock disposed on the packer and preventing movement of at least one of the setting element, the slip element, and the packing element in an uphole direction.

22. A method of setting a packer downhole in tubing subject to downhole flow at a first flow rate in an annulus between the packer and the tubing, the method comprising:

hydraulically activating a setting element disposed on the packer toward an uphole end to move in a downhole direction toward a downhole end of the packer;

moving a slip element disposed on the packer toward the downhole end outward toward the tubing in a first stage in response to the movement of the setting element in the downhole direction;

at least partially carrying a packing element, disposed on the packer uphole of the slip element, on portion of the setting element;

compressing the packing element outward toward the tubing in a second stage, after the first stage, in response to the movement of the setting element in the downhole direction; and restricting the downhole flow in the annulus between the packer and the tubing to a second flow rate less than the first flow rate by moving a choke element disposed on the packer at least downhole of the packing element outward toward the tubing in response to the movement of the setting element.

23. The packer of claim 1, wherein the choke element comprises a ring being ductile and disposed circumferentially about the slip element.

24. The packer of claim 1, wherein the choke element comprises a ring disposed downhole of the setting element and being expandable outward toward the tubing in an initial stage, before the first stage in the setting of the slip element, in response to the movement of the setting element in the downhole direction.

25. The packer of claim 1, wherein the slip element comprises a plurality of slips disposed circumferentially about the packer and having slots therebetween; and wherein the choke element comprises a plurality of spacers disposed in the slots between the slips.

* * * * *